United States Patent [19]

Medovar et al.

[11] 4,291,744

[45] Sep. 29, 1981

[54] APPARATUS FOR ELECTROSLAG REMELTING OF CONSUMABLE ELECTRODES

[76] Inventors: Boris I. Medovar, ulitsa A. Barbjusa, 22-26, kv. 109; Viktor L. Artamonov, ulitsa Shumskogo, 8a, kv.90; Pavel I. Kirsanov, ulitsa Belorusskaya, 15b, kv. 10; Alexandr M. Marchenko, ulitsa Stroitelei, 17, kv. 18; Alexei G. Bogachenko, ulitsa Sapernoe pole, 26a, kv. 30; Leonid V. Pavlov, prospekt Komarova, 28, kv. 6, all of Kiev; Jury M. Kamensky, ulitsa Novatorov, 42/5, kv. 143, Moscow; Ruslanbek B. Gutnov, ulitsa Chelyabinskaya, 23, korpus 2, kv. 199, Moscow; Pavel M. Platonov, 9 Parkovaya ulitsa, 78/2, kv. 78, Moscow, all of U.S.S.R.

[21] Appl. No.: 12,076

[22] Filed: Feb. 14, 1979

[51] Int. Cl.[3] ..... B22D 27/02; H05B 7/18

[52] U.S. Cl. ..... 164/509; 164/470

[58] Field of Search ..... 164/52, 252, 50, 250; 13/9, 12

[56] References Cited

U.S. PATENT DOCUMENTS

| | | | |
|---|---|---|---|
| 2,907,807 | 10/1959 | Noesen | 13/12 |
| 3,571,475 | 3/1971 | Holzgruber et al. | 164/52 X |
| 3,619,464 | 11/1971 | Holzgruber et al. | 13/12 |
| 3,767,831 | 10/1973 | Plockinger et al. | 164/252 X |
| 3,835,227 | 10/1974 | Paton et al. | 13/9 |
| 3,835,228 | 10/1974 | Paton et al. | 13/9 |
| 3,835,229 | 10/1974 | Paton et al. | 13/9 |
| 3,949,151 | 4/1976 | Kerton | 13/12 |

FOREIGN PATENT DOCUMENTS

| | | |
|---|---|---|
| 283613 | 8/1970 | Austria . |
| 285839 | 11/1970 | Austria . |
| 289874 | 5/1971 | Austria . |
| 707566 | 6/1968 | Belgium . |
| 1168900 | 10/1969 | United Kingdom . |
| 1326091 | 8/1973 | United Kingdom . |
| 1432356 | 4/1976 | United Kingdom . |

*Primary Examiner*—Robert D. Baldwin
*Assistant Examiner*—Gus T. Hampilos
*Attorney, Agent, or Firm*—Fleit and Jacobson

[57] ABSTRACT

In an electroslag remelting apparatus comprising electrode holders adapted to hold at least two consumable electrodes connected to different terminals of an a.c. power source, the mould and the bottom plate are electrically connected to each other and, through rectifiers, to the a.c. power source, the rectifiers being connected to the same terminals of the a.c. power source as the electrode holders. The rectifiers are so connected into the circuit as to provide a flow of only direct current through the bottom plate and mould towards the a.c. source through said rectifiers.

4 Claims, 4 Drawing Figures

APPARATUS FOR ELECTROSLAG REMELTING OF CONSUMABLE ELECTRODES

BACKGROUND OF THE INVENTION

The invention relates to electrometallurgy, and more specifically to apparatus for the electroslag remelting of consumable electrodes.

Although electroslag remelting has been practised for a comparatively long time, there is as yet no adequate solution of some problems connected with a service life of moulds and with a decrease in impurities in the metal of an ingot.

There exists a variety of apparatus for practising the electroslag remelting of metals, on the whole similar in design and comprising a bottom plate, a mould, and an a.c. power source connected to electrode holders, as is disclosed in British Pat. No. 1,168,900 and Belgian Pat. No. 707,566. The electrode holders carry consumable electrodes which are introduced into the mould, whereupon electric current is passed through them, and slag is melted down therewith in the mould. Thereafter, as the consumable electrodes fuse, under the liquid slag layer a metal pool is formed, which progressively crystallizes to form an ingot. The disadvantage of apparatus of this type consists in a deficient removal of gases from the metal pool due to both anodic electrochemical reaction and cathodic electrochemical reaction, none of which prevails over the other, and whch takes place on the liquid slag—liquid metal interface.

This disadvantage is largely overcome in an apparatus for the electroslag remelting of consumable electrodes disclosed in U.S. Pat. No. 3,652,733 which makes it possible to control chemical reactions in the molten slag on the metal pool - slag pool interface, which promotes more efficient refinement of the molten metal from inclusions of sulphur, oxygen and hydrogen. The above apparatus comprises a bottom plate and a mould which are electrically connected to each other and to one terminal of an a.c. power source, an electrode holder adapted to hold at least one consumable electrode being connected to another terminal of said a.c. power source, and an electrode holder adapted to hold at least one nonconsumable electrode being connected through rectifiers to different terminals of the a.c. source. Said rectifiers provide for superimposition of direct current onto alternating current passing through the slag pool. This being the case, the metal pool during the major part of the time is a cathode, which promotes more efficient refinement of the molten metal from sulphur, oxygen and hydrogen.

However, alongside evident advantages, the foregoing apparatus has a substantial disadvantage. Specifically, as alternating current flows through the mould, the mould wall suffers from spark discharge during the half-cycle when it is an anode. During the same half-cycle, sulphur and oxygen anions and hydroxyl anions discharge on the slag - metal pool interface, which is accompanied by the reverse transition of sulphur, oxygen and hydrogen from the slag into the ingot metal, which reduces the efficiency of refining the ingot metal.

SUMMARY OF THE INVENTION it is the primary object of the present invention to provide an apparatus for the electroslag remelting of consumable electrodes which makes it possible to prevent the mould walls from being damaged by spark discharge.

Another important object of the invention is to provide an apparatus for the electroslag remelting of consumable electrodes which enables a better removal of objectionable impurities from the metal pool, thereby improving the ingot quality.

The foregoing and other objects of the present invention are attained in an apparatus for the electroslag remelting of consumable electrodes comprising a bottom plate and a mould electrically connected to each other and to an a.c. power source, electrode holders adapted to hold at least two consumable electrodes to be introduced into the mould and connected to different terminals of the a.c. power source, and rectifiers connected to the same terminals of the a.c. power source, wherein, according to the invention, the bottom plate and the mould are electrically connected to the a.c. power source through said rectifiers which are so connected into the circuit that only direct current flows through the rectifiers, bottom plate and mould towards the a.c. source.

Such arrangement of the apparatus according to the invention makes it possible to prevent the mould walls from being damaged by spark discharge and to constantly remove from the metal pool such objectionable elements as sulphur, oxygen and hydrogen, thereby improving the ingot quality. This being the case, the consumable electrodes are melted down when only alternating current flows therethrough.

There may be various modifications of the apparatus for the electroslag remelting of consumable electrodes when utilizing both a one-phase a.c. power source and a three-phase a.c. delta or star connected power sources, with the electrode holders connected thereto.

The bottom plate and the mould may be connected to the phase terminals of the power source, in the first, through at least two rectifiers and, in the second case, through three rectifiers while, in the third case, it is advisable to use an electrode holder for an additional electrode connected to the zero terminal of a three-phase a.c. power source, and to connect the bottom plate and the mould through rectifiers both to the phase terminals and to the zero terminal of the power source.

BRIEF DESCRIPTION OF THE DRAWINGS

The objects and advantages of the present invention will be readily understood upon reference to the following detailed description of the embodiments thereof taken in conjunction with the annexed drawings wherein.

DETAILED DESCRIPTION OF THE PREFERRED EMBODIMENTS OF THE INVENTION

Figure 1:
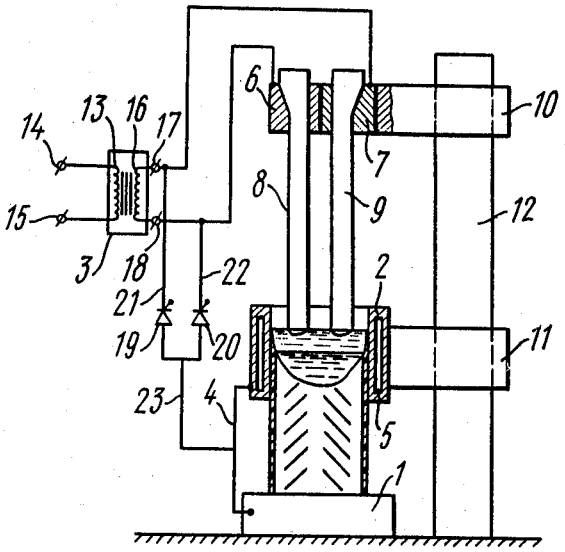
FIG. 1 shows the functional diagram of an apparatus for the electroslag remelting of consumable electrodes according to the invention.

As shown in FIG. 1, an apparatus for the electroslag remelting of consumable electrodes comprises a bottom plate 1 over which a mould 2 is placed, and an a.c. power source 3. The bottom plate 1 is electrically connected to the mould 2 through a lead 4 or directly through their bearing surfaces in the contact area in the case when the mould 2 rests on the bottom plate 1 during the whole process of remelting. The mould 2 is formed with a cooling jacket 5. Mounted above the mould 2 are electrode holders 6 and 7 for holding at least two consumable electrodes 8 and 9. The electrode holders 6 and 7 and the mould 2 are secured by brackets 10 and 11 to a vertical column 12. The brackets 10 and 11 are mounted on the vertical column 12 for progressive motion in the vertical direction.

The a.c. power source 3 is a transformer, the primary winding 13 of which has terminals 14 and 15 adapted to be connected to a supply circuit. A secondary winding 16 of said transformer has terminals 17 and 18. The electrode holders 6 and 7 are connected to different terminals of the a.c. power source 3. In particular, the electrode holder 6 is connected to the terminal 18 and the electrode holder 7, to the terminal 17 of the transformer secondary winding 16. The bottom plate 1 and the mould 2 are electrically connected to the a.c. power source 3 through rectifiers 19 and 20 which, in their turn, are connected to the terminals 17 and 18, respectively, of the transformer secondary winding 16 according to the invention. Said rectifiers 19 and 20 are connected in parallel to the a.c. power source 3 through leads 21 and 22, and connected to the bottom plate 1 through a lead 23. The rectifiers 19 and 20 are controllable by known means (for example, by resistance adjustment).

This example illustrates a modification of the apparatus according to the invention, wherein a single-phase a.c. power source is used.

Figure 2:
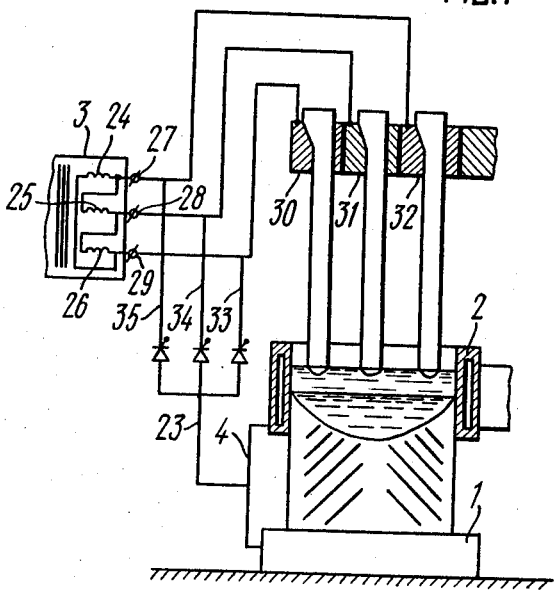
FIG. 2 shows a modification of the apparatus of the present invention, wherein a three-phase a.c. delta connected power source is used.

There may be modifications of the apparatus when it is used with a three-phase a.c. power source. In particular, there are possible schemes of the apparatus connection in star or delta configuration. Thus, FIG. 2 shows a modification of the apparatus, wherein a three-phase a.c. delta connected power source is used. As illustrated in this figure, the three-phase a.c. power source 3 is a transformer provided with windings 24, 25 and 26. The ends of said windings 24, 25 and 26 are interconnected in series into a closed triangle. Said transformer has three terminals 27, 28 and 29. An electrode holder 30 is connected to the terminal 29, an electrode holder 31 is connected to the terminal 28, and an electrode holder 32 is connected to the terminal 27 of said transformer. The bottom plate 1 and the mould 2 are connected to said phase terminals 27, 28 and 29 of the power source 3 through at least three rectifiers 33, 34 and 35. As shown in the diagram, said rectifiers 33, 34 and 35 are connected to the three-phase a.c. power source 3 in parallel to the electrode holders 30, 31 and 32. In particular, the rectifier 33 is connected to the terminal 29, the rectifier 34 is connected to the terminal 28, and the rectifier 35 is connected to the terminal 27. The rectifiers 33, 34 and 35 are connected to the bottom plate 1 through the lead 23.

Figure 3:
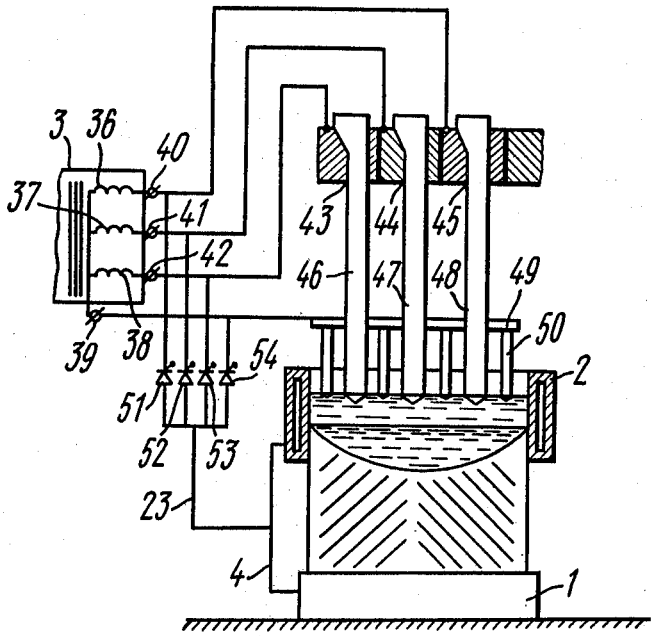
FIG. 3 shows a modification of the apparatus of the present invention, wherein a three-phase a.c. star connected power source is used.
Figure 4:
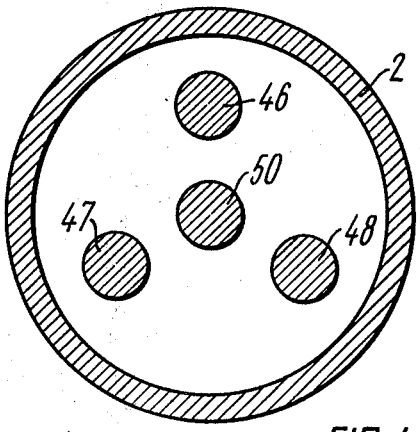
FIG. 4 shows a preferred arrangement of consumable electrodes within the mould of the modified apparatus of the present invention shown in FIG. 3.

When the three-phase a.c. star connected power source 3 is used, as is best illustrated in FIG. 3, said power source 3 is provided with windings 36, 37 and 38, each having one end thereof connected to the zero terminal 39. The other end of the winding 36 is connected to the terminal 40, that of the winding 37, to the terminal 41, and that of the winding 38, to the terminal 42. Electrode holders 43, 44 and 45 of consumable electrodes 46, 47 and 48 are connected to the phase terminals 42, 41 and 40, respectively, of the three-phase a.c. power source 3. In this case the apparatus is provided with an electrode holder 49 for an additional electrode 50 which may be either consumable or non-consumable. According to the invention the electrode holder 49 is connected to the zero terminal 39 of the three-phase a.c. power source 3. The bottom plate 1 is connected through rectifiers 51, 52 and 53 to the phase terminals 40, 41 and 42 of the three-phase a.c. power source 3, and through the rectifier 54 to the zero terminal 39. Similar to the foregoing modifications, the rectifiers 51, 52, 53 and 54 are connected to the terminals in parallel, while their outputs are connected to the bottom plate 1 through the common lead 23. The additional electrode 50 may be of any type, in particular, it may be a composite electrode, as shown in FIG. 3, or a conventional consumable electrode, similar to the electrodes 46, 47 and 48. In the latter case, it is advisable to position the electrode holder 49 of the additional electrode 50 above the central portion of the mould 2, as shown in FIG. 4, and to arrange the electrode holders 43, 44 and 45 of the consumable electrodes 46, 47 and 48 above the periphery of the mould 2.

The apparatus shown in FIG. 1 operates in the following manner. Upon pouring liquid conductive slag into the mould 2, current is supplied from the a.c. power source 3 to the electrode holders 6 and 7. Alternating current flows through the electrodes and the slag pool. Under the action of the heat liberated in the slag pool due to alternating current passing therethrough, the consumable electrodes 8 and 9 start melting, thus forming a metal pool which gradually crystallizes into an ingot.

During one half-cycle, current flows through the circuits: electrode 9-slag-electrode 8; electrode 9-slag-mould 2-rectifier 20; electrode 9-slag-metal pool-ingot-bottom plate 1-rectifier 20. During the second half-cycle current flows through the circuits; electrode 8-slag-electrode 9; electrode 8-slag-mould 2-rectifier 19; electrode 8-slag-metal pool-ingot-bottom plate 1-rectifier 19. During both half-cycles current flows through the mould 2, the ingot being cast and the bottom plate 1 only in one direction due to the connection of the rectifiers 19 and 20 into the circuit, thus preventing the mould walls from being damaged by spark discharge. As the height of the ingot increases due to the crystallization of the molten metal of the consumable electrodes 8 and 9, the mould 2 and the electrode holders 6 and 7 are progressively moved towards each other by changing the position of the brackets 10 and 11 on the vertical column 12. In so doing, the ends of the consumable electrodes 8 and 9 are continuously kept within the slag pool. In the process of the electroslag remelting of consumable electrodes, a constant direction of current flow on the slag-metal pool interface provides favorable conditions for cathode electrochemical reactions which result in removal of sulphur, oxygen and hydrogen, anion discharge of said impurities occuring both during the first and the second half-cycles, i.e. practically all the time.

Also important is the fact that when the melting of the electrodes is unbalanced, the mode of electrical connection of the mould 2 and bottom plate 1 favors a spontaneous elimination of the unbalance, for a higher current flows through the electrode which is deeper immersed into the slag pool. It is possible to control the melting rate of the electrodes by changing the resistance in the circuits of the rectifiers 19 and 20.

The modifications of the apparatus shown in FIGS. 2 and 3 of the drawings operate in a similar manner.

It is obvious that the embodiments of the present invention described hereinabove are merely illustrative and that other modifications and adaptations thereof may be made without departing from the scope of the appended claims.

What is claimed is:

1. An apparatus for the electroslag remelting of at least two consumable electrodes comprising:

a.c. power source means provided with at least two power terminals for providing a.c. power;

a bottom plate electrically connected to said a.c. power source means;

a mould electrically connected to said bottom plate; and direct connection means directly connecting said at least two power terminals to each of said bottom plate and said mould, said direct connection means comprising rectifiers, one rectifier being provided for each of said at least two power terminals, each of said rectifiers having a conductive state for electrically connecting a corresponding one of said at least two power terminals to each of said bottom plate and said mould to establish direct electrical connection therebetween, said rectifiers having a conductive direction leading from said bottom plate and said mould, on the one hand, to said at least two power terminals, on the other hand, so as to provide for a flow of only direct current through the bottom plate and the mould to the corresponding one of said at least two power terminals of said a.c. power source means;

each of said at least two consumable electrodes being connected to a different respective one of said at least two power terminals of said a.c. power source means, said a.c. power generated by said a.c. power source means being characterized by at least two a.c. power cycles, so that each given one of said at least two a.c. power cycles is applied to a respective corresponding one of said at least two consumable electrodes;

each of said at least two rectifiers being exclusively actuated to said conductive state during a corresponding respective one of said at least two a.c. power cycles;

whereby said mould suffers no harmful effects due to spark discharge.

2. An apparatus according to claim 1, wherein said a.c. power source means comprises a three-phase a.c. delta connected power source having three power terminals, said at least two rectifiers comprising three rectifiers for connecting said bottom plate and said mould to the three power terminals, respectively, of said three-phase a.c. delta connected power source.

3. An apparatus according to claim 1, wherein said a.c. power source means comprises a three-phase a.c. star connected power source having three phase terminals and a zero terminal, said apparatus being provided with an additional electrode and an additional electrode holder for holding said additional electrode, said at least two rectifiers comprising four rectifiers for connecting said bottom plate and said mould to the three phase terminals and the zero terminal, respectively, of said three-phase a.c. power source.

4. An apparatus according to claim 1, wherein said rectifiers are arranged in parallel, each rectifier connecting said bottom plate and said mould to a respective one of said at least two power terminals in parallel fashion.

* * * * *